US006364786B1

(12) United States Patent
Khano

(10) Patent No.: US 6,364,786 B1
(45) Date of Patent: Apr. 2, 2002

(54) GOLF SWING TEACHING DEVICE

(76) Inventor: Arthur Khano, 3000 W. Ardmore Ave., Chicago, IL (US) 60659

( * ) Notice: Subject to any disclaimer, the term of this patent is extended or adjusted under 35 U.S.C. 154(b) by 0 days.

(21) Appl. No.: 09/610,067

(22) Filed: Jul. 5, 2000

(51) Int. Cl.[7] ..... A63B 69/36
(52) U.S. Cl. ..... 473/257; 473/229; 473/226
(58) Field of Search ..... 473/219, 226, 473/229, 231, 257, 258, 259

(56) References Cited

U.S. PATENT DOCUMENTS

| | | | | |
|---|---|---|---|---|
| 1,567,530 A | | 12/1925 | MacNaughton et al. | |
| 3,583,707 A | * | 6/1971 | Fujimoto | 473/259 |
| 3,794,329 A | | 2/1974 | Wilson | |
| 3,795,399 A | | 3/1974 | Beckish | |
| 4,034,991 A | | 7/1977 | Oppenheimer | |
| 4,583,740 A | * | 4/1986 | Ohly | 473/259 |
| 4,949,974 A | * | 8/1990 | Bellagamba | 473/216 |
| 5,467,993 A | * | 11/1995 | Higginson | 473/229 |
| 5,816,932 A | * | 10/1998 | Alexander | 473/259 |

FOREIGN PATENT DOCUMENTS

| | | | |
|---|---|---|---|
| JP | 40/6304277 | * 11/1994 | 273/191 A |

* cited by examiner

*Primary Examiner*—Raleigh W. Chiu
(74) *Attorney, Agent, or Firm*—Edgar W. Averill, Jr.

(57) ABSTRACT

A golf swing teaching device to assist a golfer in improving his or her golf swing. The teaching device includes a frame which supports a guide shaft which is formed in the shape of an arc. A golf club is affixed at its butt end to the guide shaft. It is affixed to the guide shaft so that it may slide along the guide shaft. In this way, the golfer may swing the club and be assisted to move the butt end of the golf club in an arcuate path.

15 Claims, 3 Drawing Sheets

GOLF SWING TEACHING DEVICE

BACKGROUND OF THE INVENTION

The field of the invention is golf teaching aides and the invention relates more particularly to golf teaching aides which guide the movement of a golf club during a swing.

Teaching golf professionals are always searching for ways to demonstrate various elements of a proper swing to a student. Several devices have been created in this endeavor. One such device is shown in U.S. Pat. No. 1,567,530, which shows a ring which is supported around a golfer. A slide is affixed to the shaft of a golf club and the slide moves along the ring.

In U.S. Pat. No. 3,794,329, a golf club head is affixed to a runner and guides the movement of the golf club head along a track.

U.S. Pat. No. 3,795,399, shows a golf club which is affixed by a guide member to a shaped track. The shaped track guides the movement of the golf club as the golfer is practicing a swing.

U.S. Pat. No. 4,034,991, utilizes a weighted member. A flexible cord is affixed between the weighted member and the head of a golf club. As the golfer swings the club, the weighted member traverses the guide member.

The above devices unduly limit the movement of the golf club since they are affixed to the handle or the shaft and do not permit the person using the device to swing the club in a more natural manner. Also, most of the devices are so large and cumbersome as to prevent them from being transported from one practice area to another.

BRIEF SUMMARY OF THE INVENTION

It is an object of the present invention to provide a golf swing teaching device which is easy to assemble and permits the golfer to swing the club in a nonrestricted manner except for the butt end of the club.

The present invention is for a golf swing teaching device to assist a golfer to improve his or her golf swing. The device has a frame supported above a playing surface and supported so that there is a support free arc length at a lower portion of the guide shaft. A golf club, having a handle with a butt end, is affixed by way of a guide member slidingly along the arcuate guide shaft. A golfer may stand behind the guide shaft and swing the club and have the path of the butt end of the golf club guided in a generally arcuate path by the sliding of the guide member along the support free arc length of the guide shaft. Preferably the guide shaft is vertically and angularly adjustable along the frame. Also preferably, the guide shaft may be lengthened or shortened at its support points. Adjustable stop members may be positioned along the guide shaft to limit the length of a swing for practicing chipping and other shorter swings. The frame may include a base portion having right and left foot placement guides. The present invention also includes the process of using the invention comprising the steps of affixing a golf club to an arcuate guide shaft at the butt end of the golf club, guiding a golfer to stand so that the arms of the golfer are positioned above the arcuate guide shaft, and grasping the handle of the golf club. The golfer is then caused to move the club in a swinging movement whereby the arcuate guide shaft guides the movement of the butt of the golf club along a generally arcuate path.

DESCRIPTION OF THE PREFERRED EMBODIMENTS

A golf swing teaching device is shown in perspective view in

Figure 1:
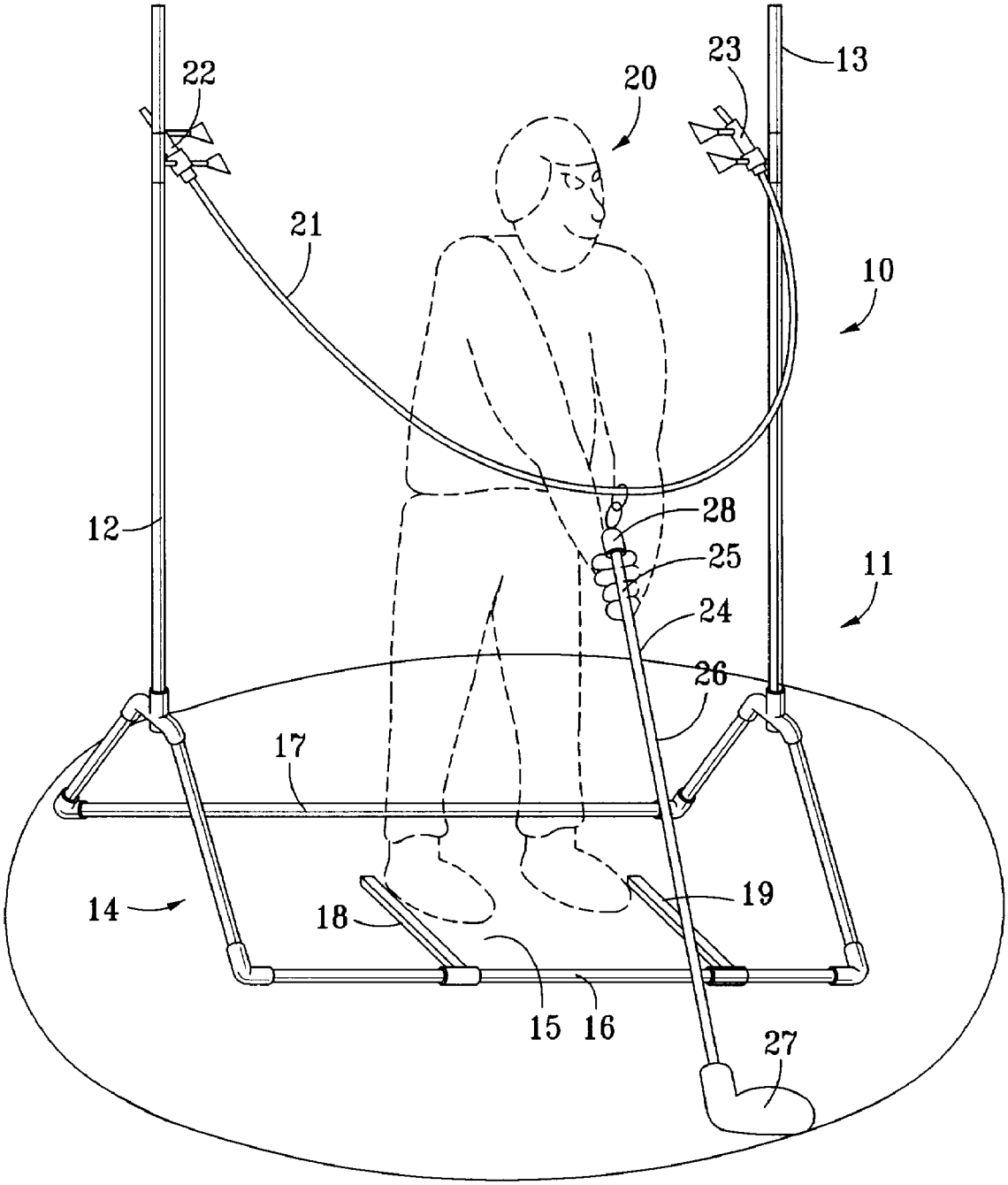
FIG. 1 is a perspective view of the golf swing teaching device of the present invention and showing a golfer in phantom view.

FIG. 1 and indicated generally by reference character 10. The teaching device has a frame 11 which includes a right vertical support bar 12 and a left vertical support bar 13. Support bars 12 and 13 are held by a base 14 supported on a playing surface 15. The base includes foot bars 16 and 17. Foot position markers 18 and 19 are slidably affixed along foot bar 16 to assist in the placement of golfer 20's feet.

An arcuate guide shaft 21 is held by a right support assembly 22 to right vertical support bar 12 and by a left support assembly 23 affixed to left vertical support bar 13.

Support assemblies 22 and 23 are both vertically and angularly adjustable as described below and shown in FIGS. 4 and 5. Arcuate guide shaft 21 is positioned in a plane at an angle to playing surface 15. This angle can be adjusted by support assemblies 22 and 23. A golf club 24 has a handle 25, a shaft 26, and a head 27. Handle 25 has a butt end 28, shown in enlarged view in FIG. 6. Butt end 28 is affixed to a guide member 29 which in turn passes through a ring 30 affixed to butt end 28.

Figure 2:
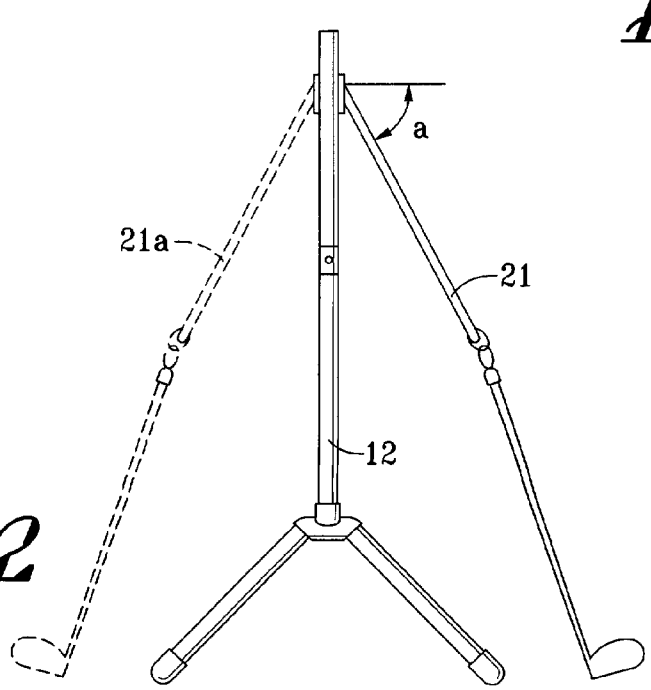
FIG. 2 is a right side view thereof.

By providing angular adjustment at right and left support assemblies 22 and 23, the device may be used by both right handed golfers and left handed golfers. As shown in FIG. 2 in phantom view, guide shaft 21 has been moved to a position where it may be used by a left handed golfer and it indicated by reference character 21". The angle of the guide shaft to the playing surface is indicated by reference character "a" in FIG. 2.

Figure 3:
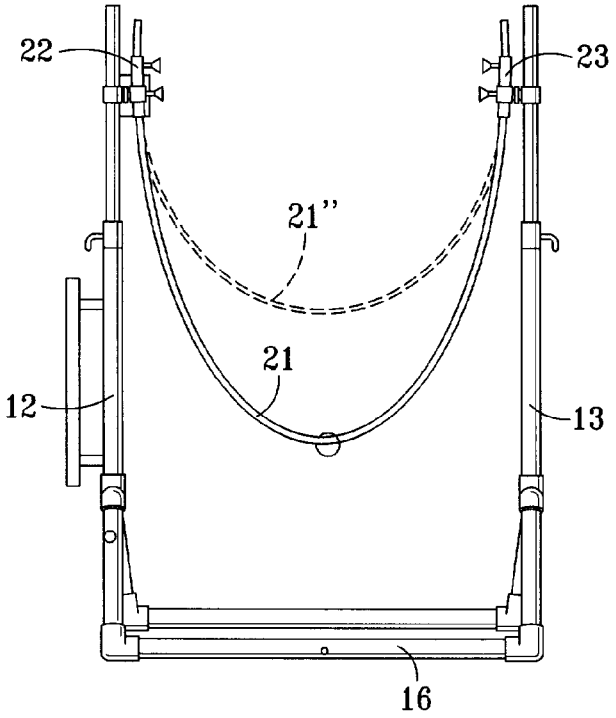
FIG. 3 is a front view thereof.

The device is shown in front view in FIG. 3. A phantom view indicated by 21" shows the movement of guide shaft 21 to an arc of a different length. This is accomplished by sliding one end of the guide shaft along one of the right or left support assemblies 22 and/or 23.

Figure 4:
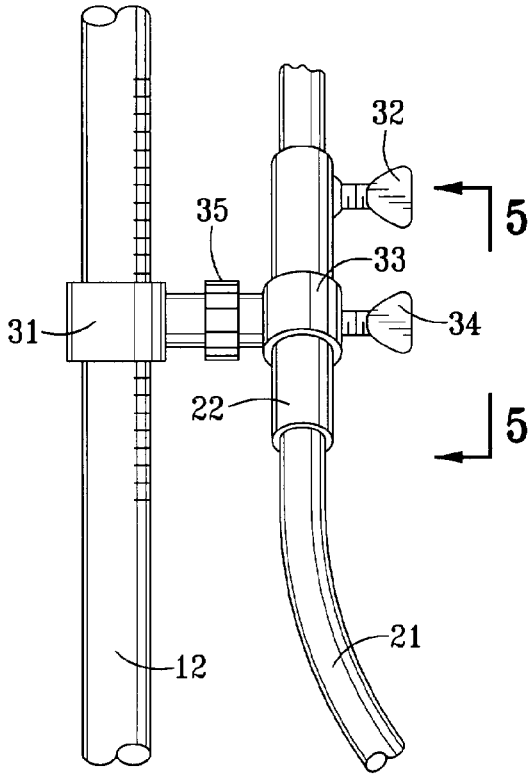
FIG. 4 is an enlarged view of a support assembly of the teaching device of FIG. 1.

The details of one way of holding the arcuate guide shaft to the frame is indicated in FIG. 4. A collar 31 surrounds right vertical support bar 12 and a tightening screw 32 holds the collar at a desired vertical position. By loosening tightening screw 32, the support assembly 22 may be raised or lowered to a desired height to compensate for the height of the golfer. The arcuate guide shaft 21 is in turn held by a collar 33 which surrounds guide shaft 21. A guide shaft tightening nut 34 holds the collar at a desired position along guide shaft 21. Collar 33 is pivotally adjustable by loosening and tightening nut 35 which affixes the relative angular positions of collars 31 and 33. Of course, numerous ways of providing such adjustments may be used and FIG. 4 indicates merely one possible method.

Figure 5:
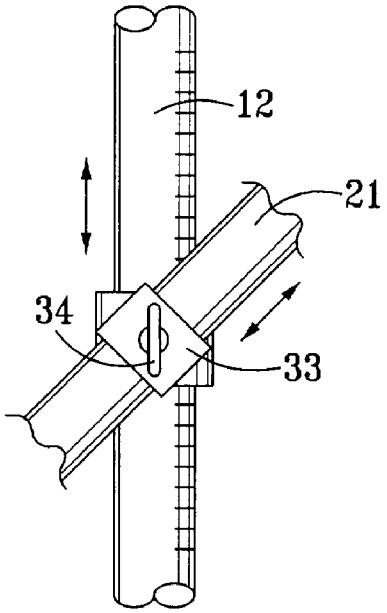
FIG. 5 is a view taken along line 5—5 of FIG. 4.
Figure 6:
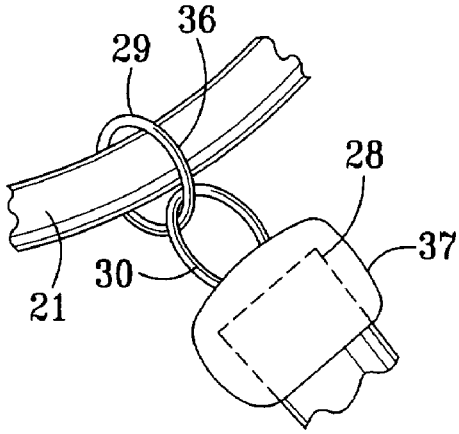
FIG. 6 is an enlarged perspective view showing the guide member and its attachment to the butt end of the golf club.

The adjustable support assembly 22 is shown in end view in FIG. 5.

It is, of course, necessary that the butt end 28 of handle 25 be guided along arcuate guide shaft 21. Thus, there must be some sort of slider which can freely move along guide shaft 21 and provide a guide member for holding the butt end 28 of golf club 24. One simple method is a guide support ring 36 slidably held over arcuate guide shaft 21. Guide support ring 36 passes through ring 30 affixed to butt end 28 of golf club 24. It is possible to utilize different clubs with the device of the present invention by providing an elastic cup 37 which is stretched over butt end 28 of the selected golf club. Thus, to change to a different golf club, the elastic cup 37 is removed from one golf club and stretched over the end of a different golf club. Whereas guide member 29 is shown as a ring 36 surrounding guide shaft 21, it, of course, could be any kind of slider including a trolley with rollers appropriately shaped for the shape of guide shaft 21.

Figure 8:
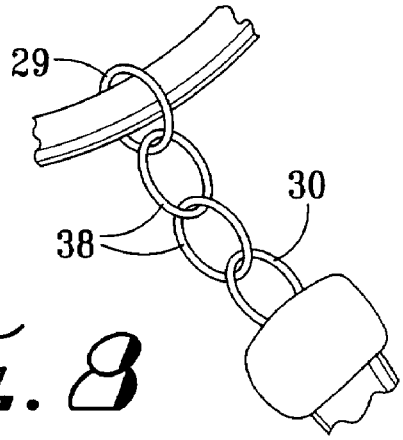
FIG. 8 is a perspective view showing an alternate attachment of the guide member to the butt end of the golf club of the device of FIG. 1.

There is also some benefit in providing a flexible support length between guide shaft 21 and butt end 28. One way of accomplishing this is shown in FIG. 8 where a plurality of chain lengths 38 are affixed between guide member 29 and ring 30. In swinging, the golfer is taught to keep the chain lengths tight to guide the movement of the golf club during the swing.

Figure 7:
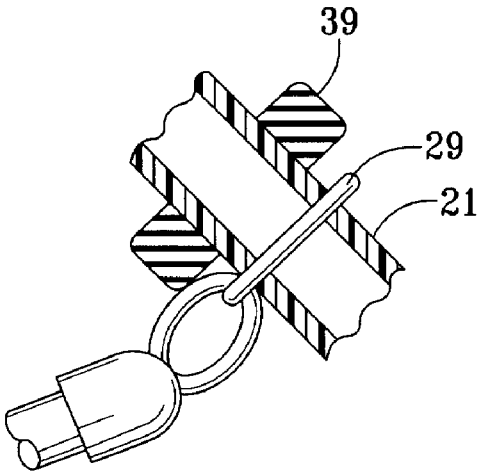
FIG. 7 is an enlarged view partly in cross-section showing a right and a left adjustable stop positioned on a portion of the guide shaft of the device of FIG. 1.

The device of the present invention has the advantage of permitting the golfer to move the head 27 of the golf club in a very natural manner. By supporting the club at the butt end, the club, of course, is free to be pivoted from the handle and provides a far more flexible swing than if the club were supported in the middle of the shaft. Preferably, the arcuate guide shaft is positioned so that the golfer's arms pass over the guide shaft. As shown in FIG. 7, a pair of adjustable stops 39 and 40 may be placed over the guide shaft 21. The stops may be made of rubber or other elastomer and moved along guide shaft 21 to a desired position for teaching a golfer the proper length of movement of the swing for shorter shots such as chipping or other short approach shots.

In use, a golf club is affixed to the guide shaft at its butt end. A golfer is guided to stand so that his or her arms are positioned above the arcuate guide shaft and the hands of the golfer are grasping the handle of the golf club. Then the golfer is caused to move the golf club in a swinging movement whereby the arcuate guide shaft guides the movement of the butt of the golf club along a generally arcuate path to demonstrate to the golfer the proper movement of the handle during the swing.

The device of the present invention may be readily disassembled and moved to any desired location. The guide shaft may be a flexible vinyl pipe or, alternatively, a more rigid member formed in a more permanent shape. When the term "arcuate" is used in the claims, it is intended to include shapes which may not be exactly in the shape of an arc but generally curved much like an arc. In other words, the shape may be formed to demonstrate a preferred movement (such as a flattened curve) even though it may be slightly different from a true mathematical arc.

Other teaching guides may be supported by frame 11, such as a mirror so that the golfer may view his or her swing. Furthermore, a tape recorder may be utilized to help train the golfer in the proper timing of the swing. Also, of course, a video camera may be utilized with the training device of the present invention to help demonstrate to the golfer his movements during the swing. Furthermore, putting strokes may be taught is with the device of the present invention. It is also possible to hit golf balls during the use of the device of the present invention which further assists in demonstrating to the golfer the effect of the proper movement of the handle of the club.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A golf swing teaching device to assist a golfer to improve a golf swing comprising:

a frame supported above a playing surface;

an arcuate guide shaft supported by said frame, said arcuate guide shaft being positioned in a plane oriented at an angle from the playing surface and supported so that there is a support-free arc length at a lower portion of said guide shaft;

a golf club having a handle having a butt end; and a guide member affixed to said golf club and positioned outwardly from the butt end of said handle, said guide member slidingly affixed to said arcuate guide shaft whereby a golfer may stand behind said guide shaft and swing the club and have the path of the butt end of the golf club handle be guided in a generally arcuate path by the sliding of the guide member along said support-free arc length of said guide shaft.

2. The golf swing teaching device of claim 1 wherein said guide member includes a ring surrounding said arcuate guide shaft.

3. The golf swing teaching device of claim 1 wherein said arcuate guide shaft is supported by said frame by a right and a left support assembly.

4. The golf swing teaching device of claim 3 further including a right and a left adjustable stop affixed to said arcuate guide shaft along said support-free arc, said right adjustable stop being positioned between said guide member and said right support assembly and said left adjustable stop is positioned between said guide member and said left support assembly.

5. The golf swing teaching device of claim 3 wherein said right and left support assemblies are vertically adjustable.

6. The golf swing teaching device of claim 3 wherein said right and left support assemblies are angularly adjustable.

7. The golf swing teaching device of claim 3 wherein at least one of said right and left support assemblies include means for selectively affixing said support assembly along said arcuate guide shaft whereby a center of curvature of said arcuate guide shaft may be adjustably affixed.

8. The golf swing teaching device of claim 1 wherein said frame includes a base portion supported on said playing surface with a bar adjacent a line where a golfer's feet are placed when using said teaching device and a right foot and left foot placement guide adjustably held by said bar.

9. The golf swing teaching device of claim 1 wherein said guide member includes a flexible length between said arcuate guide shaft and said butt.

10. The golf swing teaching device of claim 9 wherein said flexible length comprises a plurality of chain links.

11. A golf swing teaching device to assist a golfer to improve a golf swing comprising:

a frame supported above a playing surface, said frame including a right and a left vertical support bar;

an arcuate guide shaft supported at by a right support assembly by said right vertical support bar and by a left support assembly by said left vertical support bar, said arcuate guide shaft being positioned in a plane oriented at an angle from the horizontal and supported so that there is a support-free arc length at a lower portion of said guide shaft;

a golf club having a handle having a butt end; and a guide member affixed to said golf club and positioned outwardly from the butt end of said handle, said guide member slidingly affixed to said arcuate guide shaft whereby a golfer may stand behind said guide shaft and swing the club and have the path of the butt end of the golf club handle be guided in a generally arcuate path by the sliding of the guide member along said support-free arc length of said guide shaft.

12. The golf swing teaching device of claim 11 wherein said right and left support assemblies include means for vertically adjusting said support assemblies along said right and left support bars.

13. The golf swing teaching device of claim 12 wherein said right and left support assemblies include means for angularly adjusting said support assemblies.

14. The golf swing teaching device of claim 11 wherein at least one of said right and left vertical support assemblies include means for adjusting a longitudinal position of said arcuate guide shaft to a support assembly.

15. A process for teaching a golfer to improve his swing comprising:

affixing a golf club to an arcuate guide shaft at a butt end of said golf club so that the butt end is guided in movement along said arcuate guide shaft;

guiding said golfer to stand so that arms of the golfer are positioned above said arcuate guide shaft and hands of the golfer are grasping a handle of the golf club; and causing the golfer to move the golf club in a swinging movement whereby the arcuate guide shaft guides the movement of the butt of the golf club along a generally arcuate path to demonstrate to the golfer the proper movement of the handle during a swing.

* * * * *